United States Patent [19]

Meyers et al.

[11] 4,146,169

[45] Mar. 27, 1979

[54] PACKAGING STRUCTURE

[75] Inventors: George L. Meyers; Donald R. Kuehl, both of Menasha, Wis.

[73] Assignee: American Can Company, Greenwich, Conn.

[21] Appl. No.: 901,643

[22] Filed: May 1, 1978

[51] Int. Cl.[2] ..... B65D 5/36

[52] U.S. Cl. ..... 229/41 C; 229/37 R; 229/41 R

[58] Field of Search ..... 229/41 R, 41 C, 41 B, 229/37 R

[56] References Cited

U.S. PATENT DOCUMENTS

| | | | |
|---|---|---|---|
| 2,120,871 | 6/1938 | Rudowitz | 229/41 C X |
| 3,101,167 | 8/1963 | Styler | 229/41 C |
| 3,174,675 | 3/1965 | Rosenburg, Jr. | 229/41 C |
| 3,185,378 | 5/1965 | Rosenburg, Jr. | 229/41 B X |
| 3,288,348 | 11/1966 | Brackett | 229/37 R |
| 3,661,319 | 5/1972 | Koehler | 229/41 C X |
| 3,731,873 | 5/1973 | Bramgle, Jr. | 229/41 R |
| 3,827,623 | 8/1974 | Arneson | 229/41 C |
| 3,912,331 | 10/1975 | Turner et al. | 229/41 B |
| 4,010,887 | 3/1977 | Durham | 229/41 C |
| 4,105,154 | 8/1978 | Meyers | 229/27 |

FOREIGN PATENT DOCUMENTS

| | | | |
|---|---|---|---|
| 2641791 | 3/1978 | Fed. Rep. of Germany | 229/41 C |

*Primary Examiner*—Davis T. Moorhead

*Attorney, Agent, or Firm*—Robert P. Auber; Ira S. Dorman; Harry W. Hargis, III

[57] ABSTRACT

A folding paperboard carton including self-positioning, self-locking bottom wall panel structure, and mutually confronting, first side wall panels connected by mutually confronting hinged second side wall panels. The bottom wall panel structure a first bottom wall panel hinged to one of the confronting first side wall panels, and a second bottom wall hinged to the other of the confronting first side wall panels. The first bottom wall panel includes tab means affixed thereto, in the folded mode of the carton, by a line of weakness, and adhered to at least one of the side wall panels excluding the side wall panel to which the second bottom wall panel is hinged. Construction and arrangement is such that unfolding the carton to set-up mode moves the confronting first side wall panels apart, pivots the first bottom wall panel to tear it from the tab means, and presents the latter for abutting, locking engagement with the second bottom wall panel upon its pivotation to substantially coplanar relationship with the first bottom wall panel, thereby to establish and maintain set-up mode of the carton.

10 Claims, 17 Drawing Figures

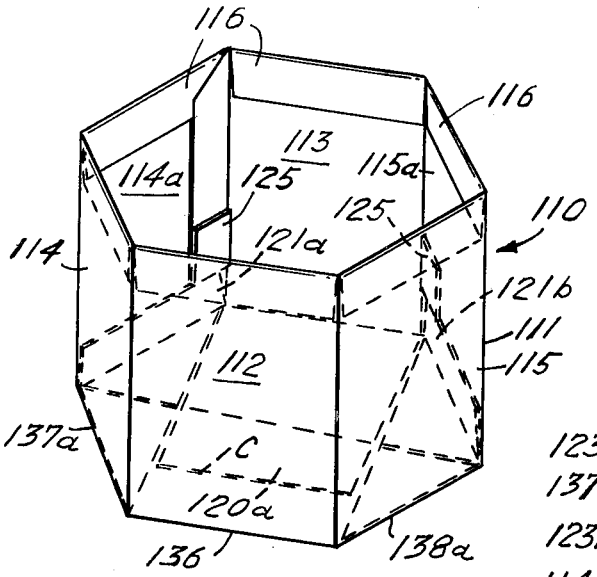
FIG. 10
FIG. 11
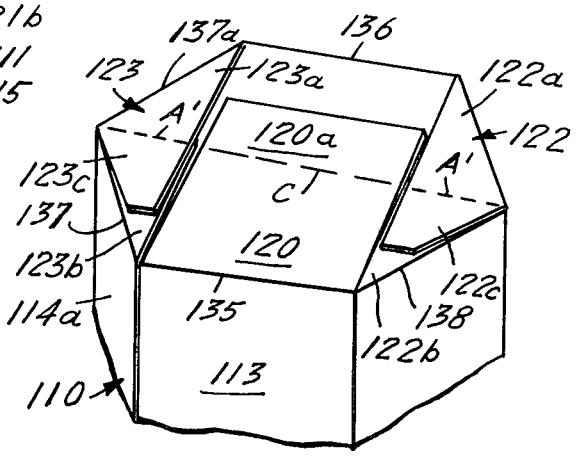
FIG. 12
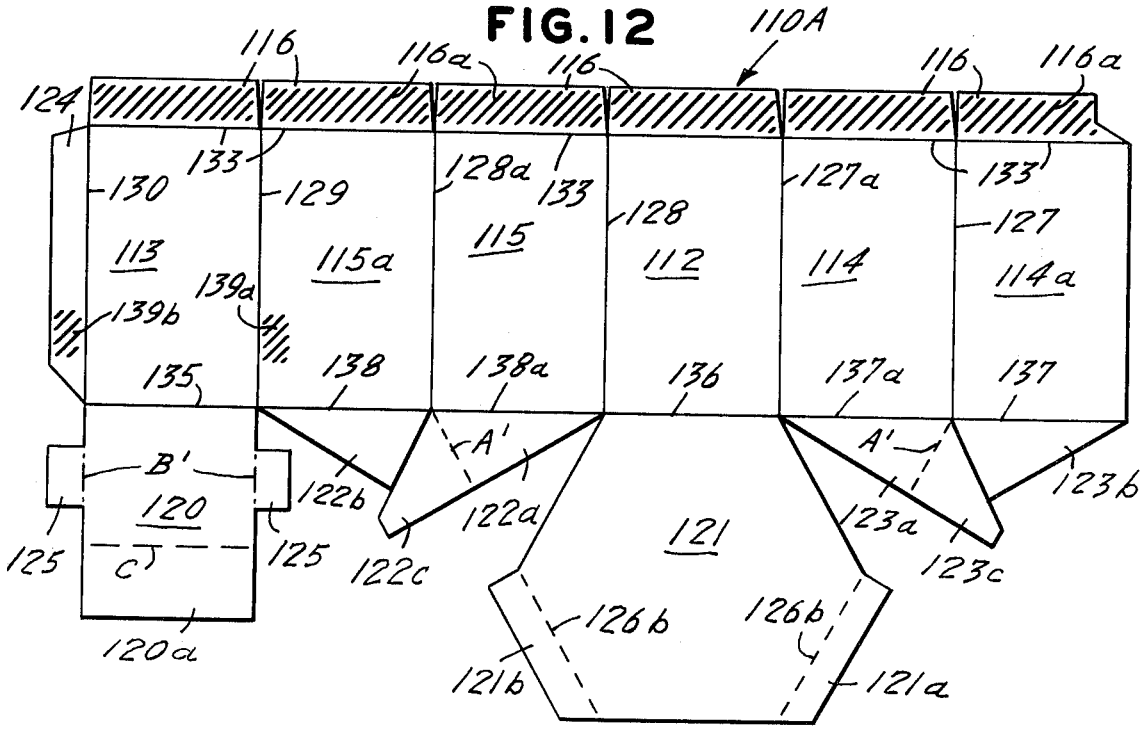

PACKAGING STRUCTURE

BACKGROUND OF THE INVENTION

This invention relates to packaging, and more particularly to improvements in the structure of folding cartons of paperboard and like materials.

Conventional folding cartons of the so-called automatic or self-erecting bottom type, particularly those of hexagonal shape found useful for packaging irregularly-shaped food articles, disadvantageously exhibit a tendency for the bottoms to dislodge from desired positions if the side walls are forced slightly out of shape.

It is a general objective of the invention to provide improved folding carton structure of the automatic-bottom type that is self locking upon unfolding to set-up mode.

It is a further objective of the invention to provide folding carton structure characterized by improved rigidity in its set-up mode.

It is a further and more specific objective to provide folding carton structure of the automatic-bottom type characterized by improved self-locking structure for the bottom.

SUMMARY OF THE INVENTION

In achievement of the foregoing as well as other objectives and advantages, the invention contemplates improved folding carton structure of the type including self-positioning, self-locking bottom wall panel structure, and mutually confronting first side wall panels connected by mutually confronting hinged second side wall panels, characterized in that: a first bottom wall panel of the bottom structure is hinged to one of the confronting first side wall panels; a second bottom wall panel of the bottom structure is hinged to the other of the confronting first side wall panels; tab means is affixed to the first bottom wall panel by a line of weakness, said tab means being adhered, in the folded mode of said carton, to at least one of the side wall panels excluding said other of said first side wall panels to which the second bottom wall panel is hinged, the construction and arrangement being such that unfolding the carton to set-up mode moves the confronting first side wall panels apart, folding the first bottom panel into position tearing the latter panel from said tab means, and affording movement of said second bottom wall panel into locking engagement with the tab means to establish and maintain set-up mode of the carton characterized by disposition of said first and second bottom wall panels in substantially coplanar relationship.

The manner in which the foregoing objectives and advantages may best be achieved will be more fully understood from a consideration of the following description, taken in light of the accompanying drawings.

BRIEF DESCRIPTION OF THE DRAWINGS

FIG. 10 is a perspective showing, similar to that of FIG. 1, of a carton in its set-up mode and embodying a modified form of the invention.

FIGS. 11 through 14 are similar to FIGS. 2 to 5, respectively, in their showings of steps for assembling the carton to its folded mode prior to unfolding to the set-up mode shown in FIG. 10.

DETAILED DESCRIPTION OF THE SEVERAL EMBODIMENTS

Figure 1:
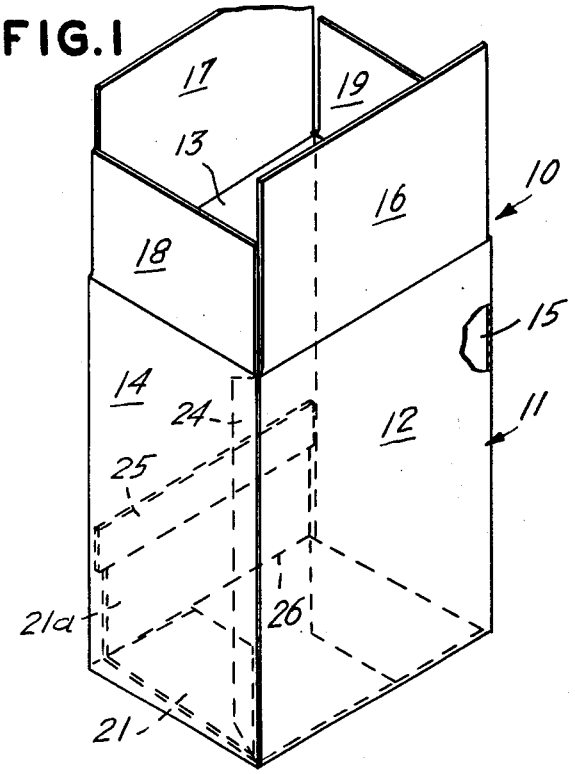
FIG. 1 is a perspective showing of a completed carton embodying one form of the invention, said carton being viewed generally from the front in its set-up mode, and having its upper wall panels in open position.
Figure 2:
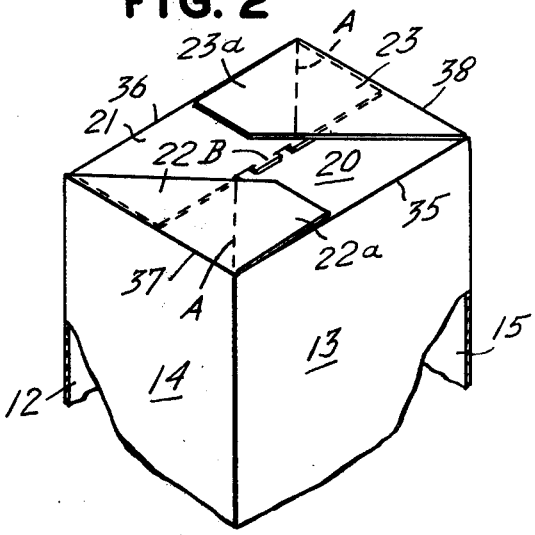
FIG. 2 is a fragmented perspective view of the carton seen in FIG. 1, inverted to show a feature of construction of the bottom structure of the carton facilitating unfolding to its set-up mode.

With more detailed reference to FIG. 1, a set-up folding carton, made of paperboard or other like suitable material, is designated generally by the numeral 10, and comprises a generally rectangular sleeve-like body portion 11 made up of rectangular, mutually confronting first side wall panels 12 and 13, respectively, and mutually confronting hinged second side wall panels 14 and 15 respectively. The carton further is provided with top closure wall panels 16, 17, 18 and 19, and bottom wall panel structure including a set of overlapping bottom wall panels designated by the numerals 20, 21, 22 and 23. The invention has particularly to do with the bottom wall panel structure, and will be further understood from a consideration of FIG. 2, which is an inverted showing of the carton seen in FIG. 1. Of the bottom wall panel structure, first bottom wall panel 21 is foldable on a first side wall panel 12 that is glued to a suitable tab 23*a* on bottom wall panel 23 that is foldable on adjacent second side wall panel 15. Panel 20 is foldable on the other first side wall panel 13 and is glued to the tab 22*a* on bottom wall panel 22 that is foldable on the other second side wall panel 14. Folding, or hinging, of wall panels 20, 21, 22 and 23 is provided by score lines 35, 36, 37, and 38, respectively.

Figure 3:
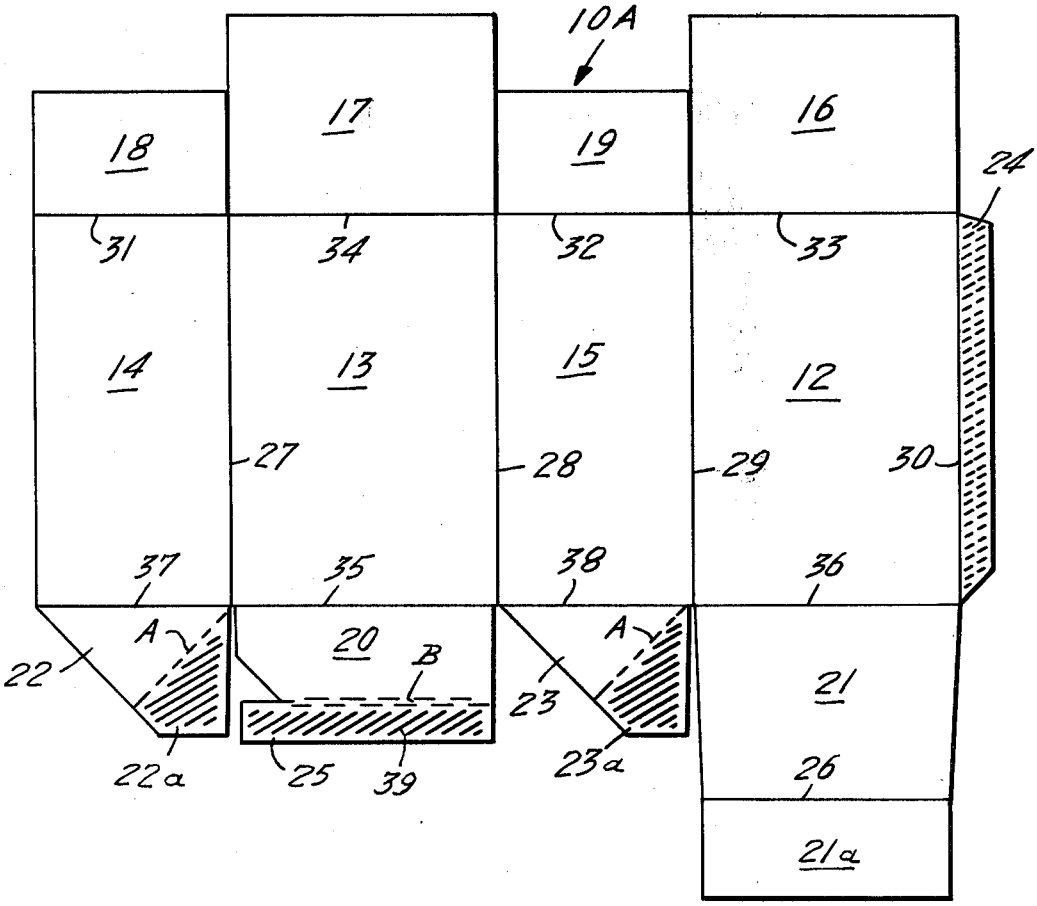
FIG. 3 is a plan view of a one-piece blank from which the folding carton of FIG. 1 is assembled.

As is seen further to advantage in FIG. 3, wherein the paperboard blank 10A for carton 10 is shown, first and second side wall panels 12, 13 and 14, 15 are hingedly interconnected as shown by score lines 27 to 29. The second side wall panels 14, 15 are hingedly attached to their top closure wall panels 18, 19 by suitably provided score lines 31, 32 as shown, and the side wall panels 12, 13 are hingedly attached to their top closure wall panels 16, 17 by score lines 33, 34 as shown. A glue flap 24 is attached by score line 30 to the right hand side of first side wall panel 12 as shown. Cut score or perforate lines A extend along trapezoidal-shaped bottom wall panels 22 and 23, through corners and sides thereof. First bottom wall panel 20 is provided with a tab 25 joined thereto by a line of weakness B. Second bottom closure panel 21 includes a foldable flap portion 21*a* affixed to its free end along score line 26.

Figure 4:
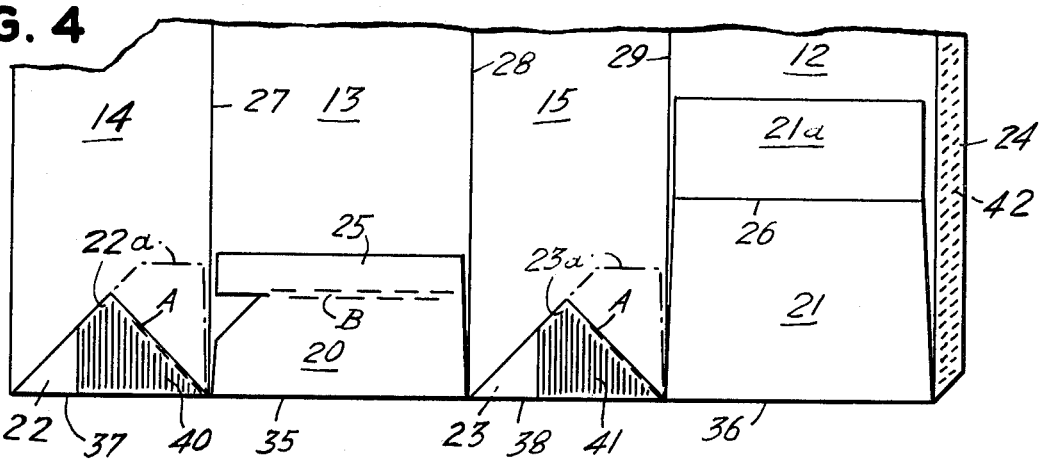
FIGS. 4 and 5 are plan views of the carton blank in successive steps of partial assembly.

To assemble carton 10 from its blank 10A, and with reference also to FIG. 4, the bottom wall panels 22, 23 are folded upwardly about their respective score lines 37, 38, and portions 22*a*, 23*a* then folded downwardly about their respective cut score lines A, A, as shown. Both of the other bottom wall panels 20, 21 are folded upwardly about their respective score lines 35, 36 and the end tab 25 of the smaller bottom wall panel 20 is adhered, by glue as seen at 39, to the side wall panel 13 as shown. Glue is then applied, as seen at 40, 41, to downturned bottom wall panel portions 22*a*, 23*a* respectively, and, as seen at 42, to the underside of flap 24. The right hand side wall panel 12 is then folded along score line 29 over onto wall panel 15, and the left hand wall panel 14 is folded along score line 27 over onto wall panel 13, as illustrated in FIG. 5.

Figure 5:
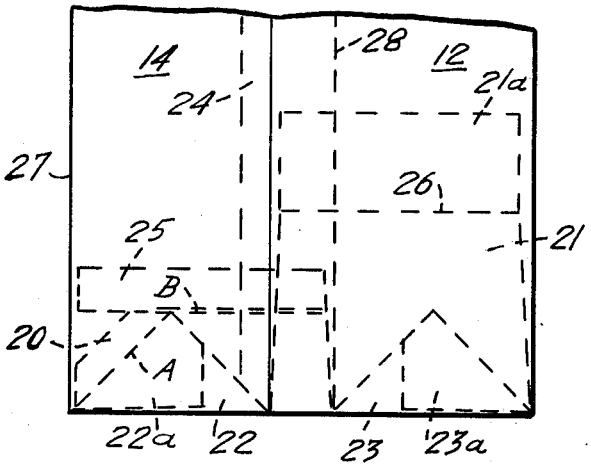

With further reference to FIG. 5, bottom wall panel portions 22*a* is adhered to a confronting portion of bottom wall panel 20, bottom wall panel portion 23*a* is adhered to a portion of bottom wall panel 21, and glue panel 24 is adhered to an overlying edge portion of side wall panel 14. The carton is now in its folded mode, essentially held in such mode by the adherence of tab 25 to side wall panel 13.

Figure 9:
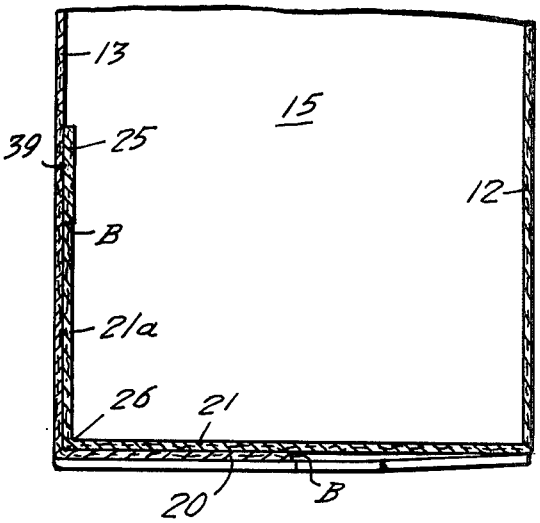
FIG. 9, is a sectional view taken along the line indicated by arrows 9—9 applied to FIG. 8 and illustrating a structural feature of the invention.
Figure 6:
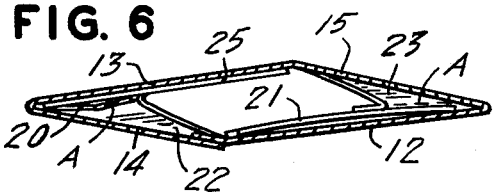
FIGS. 6, 7 and 8 are sectional views of the carton and seen from the top, illustrating successive steps of its assembly to set-up mode.
Figure 7:
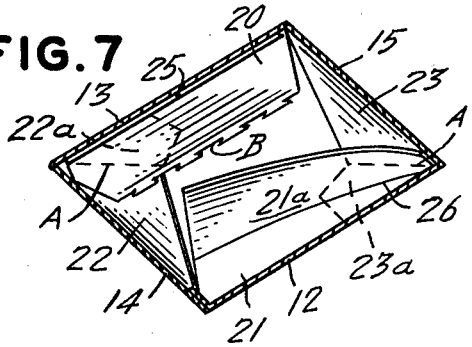
Figure 8:
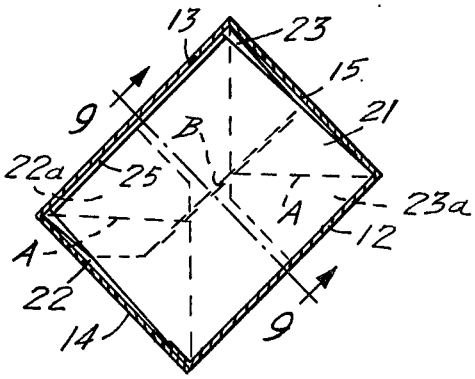

To set up the carton, and with reference to FIG. 6, the left and right ends of the folded carton as viewed in this Figure. and also in FIG. 6, are urged toward one another, through the parallelogram-shaped configuration shown. Movement to this position initiates unfolding of the accordion-like, folded bottom wall panels 22, 23 and bottom wall panels 20, 21 adherent thereto. The same unfolding initiates tearing of bottom wall panel 20 from tab 25, along line of weakness B. The unfolding also pivots bottom wall panel 21 downwardly, and continued unfolding, as is seen in FIG. 7 completes tearing of the line of weakness B. Final unfolding as is seen in FIGS. 8 and 9, and also in FIG. 1, moves the bottom wall panels 20, 21, 22, and 23 into substantially coplanar relationship to present botttom wall panel 21 as the bottom liner, and to accommodate disposition of extension 21*a* of panel 21 into coplanar, abutting engagement with the tab 25, in provision of locked set-up mode of the carton. Further to the set-up mode, bottom wall panels 22, 23 are, in effect, auxiliary panels that afford supporting engagement of bottom walls 20, 21.

Turning now to the modified embodiment illustrated in FIGS. 10 to 16, and first with reference to FIG. 10, a folding carton 110 includes a sleeve 111, of generally hexagonal cross sectional configuration made up of mutually confronting first side wall panels 112 and 113, and mutually confronting hinged second side wall panels 114, 114*a* and 115, 115*a*. The upper, open portion of the carton is defined by like inwardly folded, glued flaps designated generally by the numeral 116.

With reference also to FIG. 11, the bottom wall panel structure includes a pair of gussets 122, 123 affixed by repective score lines 137, 137*a* and 138, 138*a*, and foldable thereon accompanied by folding on cut score lines A' individual to the gussets. A first bottom wall panel 120 is hinged at score line 135 to side wall panel 113, and is provided with a portion 120*a* hinged along score line C disposed in line with score lines A' coincident with the line extending between the illustrated intersections (FIG. 11) of score lines 137, 137*a* and of score lines 138, 138*a*.

It also will be appreciated that score lines A, ' A', C define the line of folding of the bottom structure between the folded and the set-up modes of the carton.

Further to the construction of carton 110, and as is seen to advantage in FIG. 12, paperboard blank 110*a* for carton 110 include first side wall panels 112, 113, and second side wall panels 114, 114*a* and 115, 115*a* hingedly interconnected as shown on score lines 127, 127*a*, 128, 128*a*, and 129. A glue flap 124 is attached to the left hand side of side wall panel 113 by score line 130 as shown. Gussets 122, 123 in the blank 110*a* take the form, prior to assembly, of triangular flaps 122*a*, 122*b*, and 122*c* and triangular flaps 123*a*, 123*b*, and 123*c* as shown. Cut score lines A', A' separate flap 122*c* from flap 122*a*, and flap 123*c* from flap 123*a*, respectively. Bottom wall panel 121 is of hexagonal shape and is provided with tabs 121*a*, 121*b* hinged thereto on cut score lines 126*a*, 126*b*.

A pair of tabs 125 are provided, one on each side of first bottom wall panel 120, at lines of weakness B', B', a distance from fold line 135 about the same as the width of each tab 121*a* and 121*b*, for reasons to be more fully explained in what follows.

Figure 13:
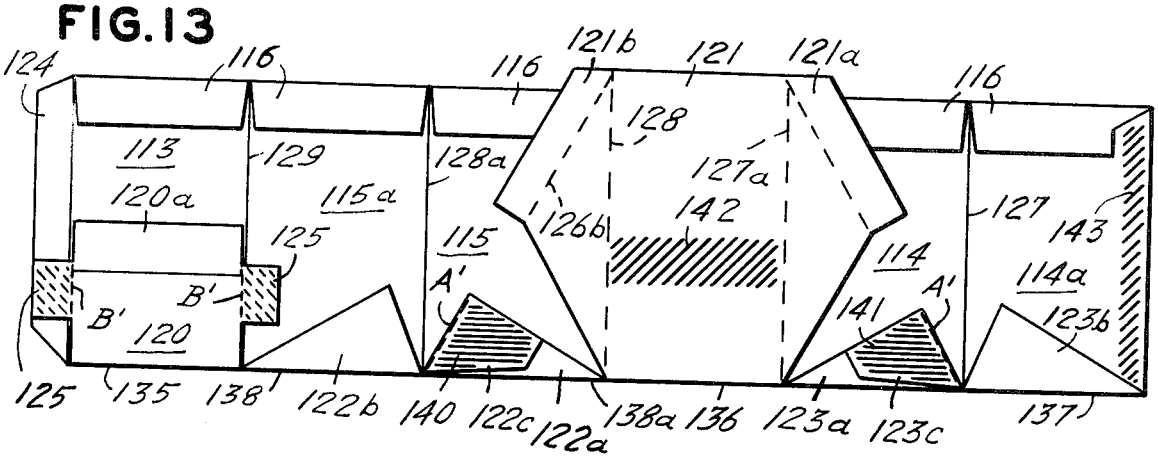

To assemble the carton to its folded mode, and still with reference to FIG. 12, and with reference also to FIG. 13, flaps 122*a*, 122*b*, and 122*c* are folded onto side wall panels 115, 115*a* about score lines 138, 138*a*, and flaps 123*a*, 123*b*, and 123*c* are folded onto side wall panels 114, 114*a* about score lines 137, 137*a*. Flaps 122*c* and 123*c* are then turned downwardly about cut score lines A', A', and a suitable adhesive such as, for example, glue is applied to the areas designated generally by the numerals 140, 141, 139*a*, 139*b*, and 116*a*. Top flaps 116 are then turned downwardly about their score lines 133 and glued in place. Bottom wall panel 120 is folded upwardly about score line 135 onto side wall panel 113 to glue tabs 125 in place as shown. Bottom wall panel 121 is turned upwardly about score line 136 onto side wall panel 112, and glue is applied to the areas designated generally by the numerals 142 and 143.

Figure 14:
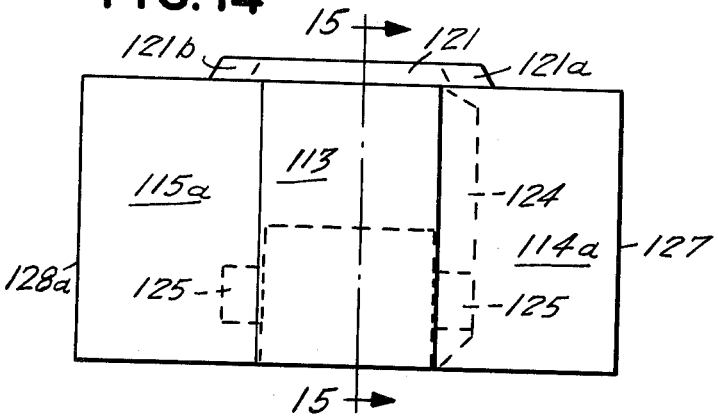

With reference further to FIG. 14, side wall panels 113, 115*a* are folded as a unit to the right, about score line 128*a* onto the folded bottom wall panel 121 so that flap portion 120*a* becomes glued at 142 to bottom wall panel 121. Side wall panel 114*a* is then folded to the left about score line 127 to adhere glue flap 124 to the portion of side wall panel 114*a* to which glue 143 is applied. Carton 110 is now in its folded mode, being held in such mode by the adherence of tabs 125 to flap 124 and wall panel 115*a* The folded mode of carton 110 is illustrated further to advantage in the sectional showing of FIG. 15. It will be appreciated that the right hand tab 125 as viewed in FIG. 14 is, in effect, glued to side wall panel 114*a* since this tab is glued to flap 124 which is glued to side wall panel 114*a*.

Figure 16:
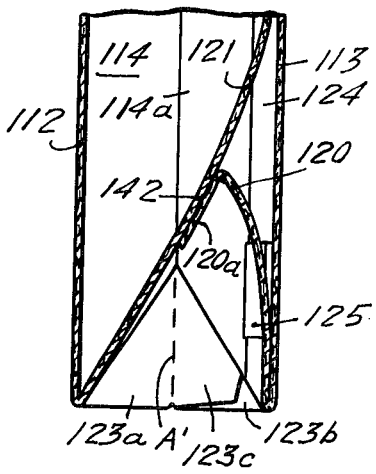
FIG. 16 is a view similar to FIG. 15, with parts broken away and illustrating partial assembly of the carton to set-up mode.
Figure 15:
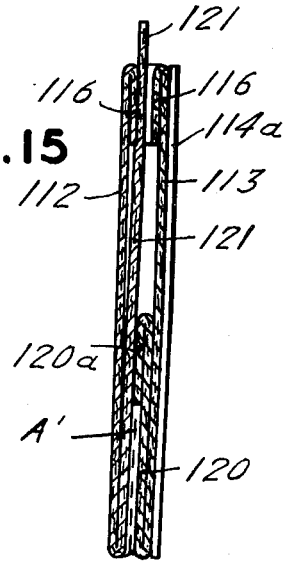
FIG. 15, is an enlarged, sectional view taken along the line indicated by arrows 15—15 applied to FIG. 14.
Figure 17:
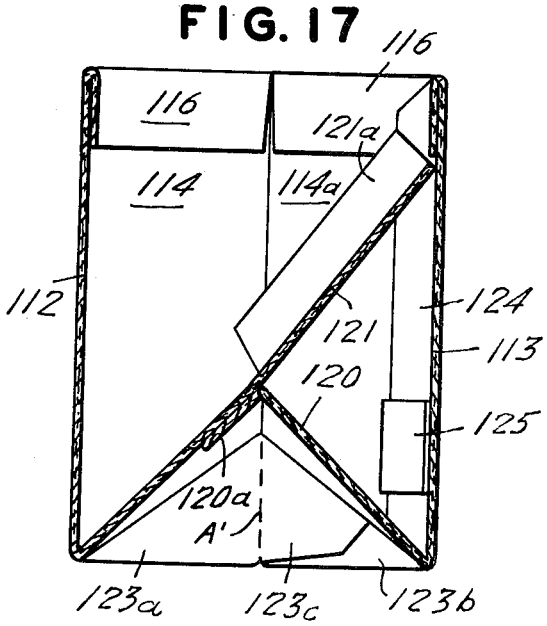
FIG. 17 is a full sectional showing similar to FIG. 15, and illustrating further partial assembly of the carton to set-up mode.

To transform or unfold the carton to set-up mode, force is applied inwardly to opposite ends of the carton as illustrated in FIG. 14. As is seen in FIG. 16, continued force causes confronting first side wall panels 112, 113 to move apart, and glued-together bottom wall panels 120, 121 begin to pivot downwardly, concurrently with downward pivotation of gussets 123. Downward pivotation of bottom wall panel 120 initiates tearing of glued tabs 125 therefrom along lines of weakness B', B', which tearing is complete in the showing of FIG. 17. Also in FIG. 17, tabs 121*a*, 121*b* are engaged by side wall panels 114*a*, 115*a* and caused to fold upwardly on their cut score lines 126*a*, 126*b*. Continued unfolding of the carton moves bottom wall panels 120, 121 and gussets 123 into substantially coplanar relationship in which the latter serve as auxiliary support panels for bottom wall panels 120, 121 and snaps tabs 121*a*, 121*b* into locking engagement with the edges of tabs 125, as is illustrated in FIG. 12.

It will be appreciated from the foregoing that the invention affords improved folding paperboard carton structure of the self-locking automatic-bottom type fabricated from a single carbon blank. While a pair of embodiments of the invention have been illustrated and described, it will be appreciated that other modifications may be made without departing from the scope of the appended claims.

We claim:

1. In folding carton structure of the type including mutually confronting first side wall panels connected by mutually confronting second side wall panels hinged thereto, improved self-positioning, self-locking bottom wall panel structure comprising: a first bottom wall panel hinged to one of the confronting first side wall panels; a second bottom wall panel hinged to the other of the confronting first side wall panels; tab means adhered to a side wall panel other than the recited side wall panel to which said second bottom wall panel is hinged, said tab means in the folded mode of said carton being affixed to the first bottom wall panel by a line of weakness, the construction and arrangement being such that unfolding the carton to set-up mode moves the confronting first side wall panels apart, and is operable to pivot the first bottom wall panel into position tearing the latter panel from the tab means along said line of weakness, thereupon affording movement of said second bottom wall panel into locking engagement with the tab means to establish and maintain set-up mode of the carton.

2. Carton structure according to claim 1, and characterized in that said first bottom wall panel includes a free end portion hingedly connected to a central portion of said second bottom wall panel, and in that said tab means includes a pair of tabs connected to opposite side portions of said first bottom wall panel by lines of weakness that extend transversely of the lines of hinging of said first and second bottom wall panels, said tabs each adhered to one of said second side wall panels.

3. Carton structure according to claim 1, and characterized by the inclusion of foldable bottom wall panels on each of said side wall panels, each affixed to said first bottom wall panel and operable upon the recited unfolding to set-up mode to pivot said first bottom wall panel to tear along said line of weakness, and further in that said tab means includes a tab connected to said first bottom wall panel by a line of weakness that extends substantially parallel to the lines of hinging of said first and second bottom wall panels.

4. Carton structure according to claims 2 or 3, and characterized in that said second bottom wall panel includes a flap portion foldable thereon and presentable, in the set-up mode of the carton, for abutting locking engagement with said tab means.

5. In a folding carton structure including a foldable sleeve-like body portion having confronting side wall panels that are relatively closely spaced in a folded mode of said carton structure and less closely spaced in a set-up mode of said carton structure, and a closure portion hingedly connected to said body portion, the combination of means for locking said carton structure in its set-up mode comprising: means defining a tab affixed to said body portion; means defining detachable interconnection of said tab to said closure portion in the recited folded mode of said carton structure, said means defining detachable interconnection of the tab and said closure portion being so co-operably disposed that, upon unfolding said carton structure to the recited set-up mode, said tab is detachable from said closure portion and positionable for locking engagement with the latter to establish and to maintain the set-up mode of said carton structure.

6. Carton structure according to claim 5, and characterized in that said closure portion comprises a pair of bottom wall panels each hingedly attached to opposed ones of said side wall panels, said tab being affixed to one of said bottom wall panels along a line of weakness and adherent to a side wall panel other than the one to which the other of said bottom wall panels is hinged, in the recited folded mode of the carton structure, said tab being tearable along said line of weakness upon the recited unfolding to set-up mode, and presented to engage a provided folded portion of the other of said bottom wall panels in provision of the recited locking engagement.

7. Carton structure according to claim 6, and characterized in that said tab is adhered to the side wall panel to which the recited one bottom wall panel is hingedly attached.

8. Carton structure according to claim 6, and characterized in that said side wall panels include a pair of opposed, parallel wall panels interconnected by a pair of opposed, transversely extending wall panels hinged to the parallel panels, said tab being adherent to one of said transversely extending panels, and said bottom wall panel to which said tab is affixed being hinged to one of said parallel side wall panels.

9. Carton structure according to claim 7, and characterized in that said side wall panels include a pair of opposed, parallel wall panels interconnected by a pair of opposed, transversely extending wall panels, and including auxiliary bottom wall panels hinged on said transversely extending side wall panels and pivotal to a position supportingly engaging said bottom wall panels upon the recited unfolding to set-up mode.

10. Carton structure according to claim 8, and characterized by the inclusion of auxiliary bottom wall panels hinged on said transversely extending side wall panels and pivotal to a position supportingly engaging said bottom wall panels upon the recited unfolding to set-up mode.

* * * * *